US005761594A

United States Patent [19]

Seto et al.

[11] Patent Number: 5,761,594

[45] Date of Patent: Jun. 2, 1998

[54] IMAGE FORMING APPARATUS

[75] Inventors: Mitsuru Seto, Yamakita-machi; Shigeru Fukuda, Kawasaki; Yasuo Hirano, Numazu; Jun Aoto, Numazu; Masahide Yamashita, Numazu; Takashi Bisaiji, Yokohama; Makoto Ohsaki, Yokohama; Takeshi Shintani, Yokohama, all of Japan

[73] Assignee: Ricoh Company, Ltd., Tokyo, Japan

[21] Appl. No.: 557,557

[22] Filed: Nov. 14, 1995

[30] Foreign Application Priority Data

| | | | |
|---|---|---|---|
| Nov. 15, 1994 | [JP] | Japan | 6-280725 |
| Nov. 30, 1994 | [JP] | Japan | 6-296638 |
| Oct. 31, 1995 | [JP] | Japan | 7-283588 |

[51] Int. Cl.[6] ..... G03G 15/01

[52] U.S. Cl. ..... 399/302; 399/308

[58] Field of Search ..... 355/271, 272, 355/273, 274, 275, 277, 279, 326 R, 327; 399/297, 302, 308, 66, 318, 399

[56] References Cited

U.S. PATENT DOCUMENTS

| | | | |
|---|---|---|---|
| 3,893,761 | 7/1975 | Buchan et al. . | |
| 3,955,530 | 5/1976 | Knechtel | 399/318 X |
| 3,973,843 | 8/1976 | Lindblad et al. . | |
| 4,788,572 | 11/1988 | Slayton et al. . | |
| 5,053,827 | 10/1991 | Tompkins et al. . | |
| 5,233,397 | 8/1993 | Till . | |
| 5,510,886 | 4/1996 | Sugimoto et al. . | |
| 5,530,532 | 6/1996 | Iino et al. . | |

FOREIGN PATENT DOCUMENTS

| | | |
|---|---|---|
| 56-5568 | 1/1981 | Japan . |
| 5-40417 | 2/1993 | Japan . |

*Primary Examiner*—Sandra L. Brase

*Attorney, Agent, or Firm*—Oblon, Spivak, McClelland, Maier & Neustadt, P.C.

[57] ABSTRACT

In an image forming apparatus of the type transferring a plurality of toner images of different colors sequentially formed on an image carrier sequentially to an endless intermediate transfer body one above the other by primary transfer, and then transferring the resulting composite color image to a transfer medium by secondary transfer, the intermediate transfer body is provided with surface energy, surface tension or adhering force which is greater than or equal to the corresponding value of the image carrier, but smaller than or equal to the corresponding value of the transfer medium.

14 Claims, 11 Drawing Sheets

III & IV SAME IN LINEAR VELOCITY

III & IV DIFFERENCE IN LINEAR VELOCITY

IMAGE FORMING APPARATUS

BACKGROUND OF THE INVENTION

The present invention relates to a copier, printer, facsimile apparatus or similar electrophotographic image forming apparatus and, more particularly, to an image forming apparatus of the type transferring a toner image from an image carrier to an intermediate transfer body by primary transfer and then transferring it from the intermediate body to a transfer medium by secondary transfer.

In an image forming apparatus of the type described, the image carrier and intermediate transfer body are generally implemented as a photoconductive element and an endless intermediate transfer belt, respectively. A plurality of color images are sequentially formed on the photoconductive element while being sequentially transferred to the belt one above the other (primary transfer). The resulting composite image on the belt is transferred to a paper or similar transfer medium at a time (secondary transfer). Such an intermediate image transfer system is applied to, e.g., a full-color image forming apparatus which reproduces color-separated document images on the basis of subtractive mixture using black, cyan, magenta and yellow toner.

The problem with the above image forming apparatus is that the transfer of the toner is apt to locally fail at the primary and secondary transfer stages. As a result, a full-color image transferred to a paper or similar transfer medium is locally lost or omitted in spots. The local omission of an image occurs with some areas when the image has a substantial area, or appears as breaks in the case of a line image. In order to obviate the local omission of an image, i.e., to enhance the transfer ability, various technologies have proposed in the past and may generally be classified into five groups, as follows.

[1] Reducing Surface Roughness of Intermediate Body (a) The intermediate body is formed of an elastomer and provided with a particular surface roughness, as disclosed in Japanese Patent Laid-Open Publication No. 3-242667 by way of example. This scheme enhances the close contact of the intermediate body and transfer medium and thereby improves the transfer ability.

(b) The intermediate body is provided with a particular surface roughness to improve the transfer ability, as taught in, e.g., Japanese Patent Laid-Open Publication Nos. 63-194272, 4-303869, 4-303872, and 5-193020.

The schemes belonging to the group [I] relate to the transfer of toner at the primary and secondary transfer stages and may be regarded as accompanying discharge. Assuming that the intermediate body has an extremely irregular surface, a more intense electric field acts on the toner at convex portions than at concave portions. Assuming that toner particles present in the convex portion and concave portion have an identical shape, then the particle at the convex portion is subjected to a more intense field, i.e., a greater electrostatic force and transferred more easily than the particle at the concave portion. Stated another way, the particle at the concave portion cannot be easily transferred. Further, the particle positioned at the edge of the concave portion adheres to the intermediate transfer member more strongly than the particle at the edge of the convex portion. This also prevents the particle at the concave portion from being easily transferred. Preferably, therefore, the surface roughness of the intermediate body should be reduced up to a level at which the difference in transfer ability due to irregularity of the surface is not critical. This is also true with a photoconductive element. Providing a photoconductive element with a preselected surface roughness in consideration of the transfer ability has been customary in the art, even with a selenium drum which is the oldest form of a photoconductive element.

Therefore, adjusting the surface roughness of the intermediate body up to a level at which the above difference in transfer ability is not critical is meaningful for the prevention of the local omission of an image.

[II] Setting Linear Velocities of Transfer Members

The transfer members are each provided with a particular linear velocity in order to improve the transfer ability. This will be described taking the primary transfer as an example. When the photoconductive element and intermediate body are driven at the same linear velocity, an electric force must be exerted such that the toner is transferred from the image carrier to the intermediate body only by the electric field which counteracts adhesion between the photoconductive element and the toner. In light of this, the photoconductive element and intermediate body are each driven at a particular linear velocity. When the linear velocities of the two members are different, both a mechanical force derived from the difference in linear velocity and an electric force derived from the electric field can act on the toner in the event of transfer. Considering the local omission of an image as an occurrence attributable to the microscopic failure of transfer, it may be said that the difference in linear velocity is desirable for the prevention of the local omission.

[III] Reducing Pressure at Nip

A nip for image transfer is provided with a particular pressure for improving the transfer ability, as taught in, e.g., Japanese Patent Laid-Open Publication Nos. 1-177063 and 45-284479. This will be described taking the primary transfer as an example. At the primary transfer stage, the photoconductive element and intermediate body are pressed against each other by a mechanical or an electrostatic force (nip pressure). That is, the toner intervening between the photoconductive element and the intermediate body is pressed. The pressure reduces the distance between nearby toner particles and thereby increases van del Waals' forces. This, coupled with the fact that the attraction between the particles increases due to the cohesion of the particles, indicates that the nip pressure should preferably be reduced from the transfer ability standpoint.

[IV] Reducing Surface Energy of Intermediate Body (a) The intermediate body is provided with a small degree of wettability in order to enhance the transfer ability, as disclosed in Japanese Patent Laid-Open Publication Nos. 2-198476 and 2-212867 by way of example. The word "wettability" refers to adhesion or adhering force acting between a liquid and a solid. The adhering force is representative of energy necessary for separating two different substances. Assuming that a liquid has a surface tension $\gamma_A$ and contacts a solid at an angle $\theta$ when put on the solid, an adhering force W acting between the liquid and the solid may be expressed as:

$$W=\gamma_A(1+\cos\theta) \qquad \text{Eq. (1)}$$

The surface tension (=critical surface tension) of a material X can be determined, as follows. After reagents each having a particular surface tension $\gamma_A$ have been dropped on the material X, their contact angles $\cos\theta$ are measured. Then, a relation between the surface potentials $\gamma_A$ of the reagents and the contact angles $\cos\theta$ is plotted. The points of the resulting plot are connected. A surface potential $\gamma_A$ at a point where the extension of the resulting line intersects a line of $\cos\theta=1$ is determined. This surface potential is referred to as a critical surface tension (=surface tension).

Assume that the wettability W of various materials are measured by use of the same reagent, e.g., water. Then, because the same reagent is used, the surface potential $\gamma_A$ of the Eq. (1) is constant. Hence, the wettability W and the contact angle cosθ are proportional to each other. It follows that to measure the wettabilities W of various kinds of materials with the same reagent means to determine the contact angles cosθ with the same surface tension $\gamma_A$. In a plot of the kind mentioned above, the line is linear in many cases; the gradient does not noticeably vary from one material to another material. Thus, the comparison between wettabilities using the same reagent, e.g., water may be regarded as the comparison between surface tensions.

The above Laid-Open Publication Nos. 2-198476 and 2-212867 obviate the local omission by using an intermediate body having low wettability, i.e., small surface energy.

(b) The intermediate body has a laminate structure and has the outermost layer formed of a material having a high parting ability, as shown and described in, e.g., Japanese Patent Laid-Open Publication Nos. 62-293270, 5-204255, 5-204257, and 5-303293.

(c) A substance having a high parting ability is fed to the intermediate body in order to enhance the transfer ability, as disclosed in, e.g., Japanese Laid-Open Publication No. 58-187968. The schemes of the group [IV] lower the surface tension of the intermediate body and thereby enhances the separation of the toner, i.e., the transfer of the toner to the transfer medium. An adhering force acting between different kinds of substances is expressed as a function of surface tension, as well known in the art. The adhering force of the toner to the intermediate body increases with an increase in surface tension. In the case of a pure substance, the surface tension is equivalent to the surface energy in meaning. For substances in general, whether they be pure or not, the surface tension is dealt with as a substitute for the surface energy like wettability.

The adhering forces between the toner and the image carrier, between the toner and the intermediate body, and between the toner and the transfer medium are each the sum of all the physical forces including the electrostatic forces of the constituent parts and van del Waals' forces.

[V] Removing Toner Film from Intermediate Body

The surface of the intermediate body suffered from toner filming is ground and refreshed thereby in order to enhance the transfer ability, as taught in, e.g., Japanese Patent Laid-Open Publication Nos. 5-273893, 5-307344, 5-313526, and 5-323802. This scheme eliminates the local omission of an image attributable to aging.

Among the above groups of technologies [I]–[IV], assume that the group [IV] is successful to reduce the surface tension of the intermediate body, as expected. Then, the intermediate body is free from toner filming and makes the group [V] needless. In this sense, the group [V] is complementary to the group [IV].

The local omission of an image at the secondary transfer stage often occurs when use is made of a roller as secondary transfer means, for the following two reasons (a) and (b).

(a) In the case of a full-color image, the toner layer has a substantial thickness. In addition, an intense mechanical adhering force, which is a non-Coulomb's force acting between the intermediate body and the toner, is generated due to the contact pressure attributable to the roller. Specifically, the roller pressure and, therefore, the mechanical adhering force increases due to the contact of the roller. This, in turn, increases the effective density of the toner and, therefore, van del Waals' forces. As a result, adhesion between the toner particles increases.

(b) When an image forming process is repeated, the toner forms a film on the intermediate body. This toner filming cause an adhering force to act between the intermediate body and the toner. Specifically, although the intermediate body is usually formed of a material whose surface tension and surface energy are small enough to obviate toner filming, (i) a certain adhering force matching the surface tension between the intermediate body and the toner is not avoidable. Once toner filming occurs, the adhering force between the intermediate body and the toner turns out (ii) an adhering force determined by the surface tension between the toner particles. Obviously, the force (ii) is more intense than the force (i). The increase in the adhering force between the toner particles prevents a part of the toner from being transferred.

In order to eliminate the above problem, U.S. Pat. No. 5,053,827 entitled "METHOD AND APPARATUS FOR INTERMITTENT CONDITIONING OF A TRANSFER BELT" discloses a conditioning process using a conditioning roller. The conditioning roller is made of a fluorine-contained material whose surface energy is smaller than the surface energy of an intermediate transfer belt. The roller is held in contact with the intermediate belt s o as to reduce its surface energy. USP '827 reports, by taking a transfer belt formed of polycarbonate as an example, that the initial surface energy of the belt is 37 to 38 dyn-cm, that without the conditioning process the surface energy increases to 40 to 45 dyn-cm, and that image transfer becomes defective when the surface energy exceeds 40 dyn-cm. In light of this, USP '827 teaches that a roller formed of, e.g., a fluorine-based material whose surface energy is less than 30 dyn-cm is held in contact with the belt, and that a thin coating layer of fluorine is formed on the belt in order to prevent the surface energy of the belt from increasing.

USP '827 further reports that when the surface energy of the belt is excessively low, the toner transfer from the photoconductive element to the intermediate belt becomes defective. In this respect, we found that when the intermediate belt is implemented by polycarbonate, the local omission of an image occurs at the secondary transfer stage due to aging. Also, we conducted a series of experiments by using an intermediate belt to which an adequate amount of zinc stearate was applied as a lubricant. The experiments showed that although the secondary transfer is satisfactory, the amount of toner deposition is reduced and results in a blurred image. The blurred image was found to occur from the beginning. Moreover, when the intermediate belt was formed of ETFE (ethylene tetrofluoroethylene), the above blurring occurred at the initial stage. This presumably stems from the following. The surface energy of the intermediate belt is reduced to a certain level by the conditioning process.

By contrast, the surface energy of the photoconductive element or image carrier sequentially increases due to toner filming and ozone, nitrogen oxides and other gases generated by a corona charger. This allows the toner to easily mechanically adhere to the photoconductive element despite that the element is ground by, e.g., a cleaning brush roller. The resulting fall of transfer ability translates not only into the local omission of a toner image but also into the reverse transfer of toner from the intermediate belt to the photoconductive element. Specifically, in an apparatus of the type sequentially transferring black, cyan, magenta and yellow toner to the intermediate belt in this order, a character or similar image formed by the black toner is reversely transferred from the belt to the photoconductive element in the subsequent step. Why the defective transfer occurred with the ETFE belt from the beginning is presumably that the difference in surface energy between the photoconductive element and the intermediate belt was great at the initial stage.

In order to obviate the above problems, USP '827 teaches that the conditioning process is effected when the surface energy of the intermediate belt increases to an excessive value. Specifically, the conditioning process i s effected when a preselected number of copies are produced.

The conventional schemes [I]–[V] have been proposed independently of each other as measures for enhancing the transfer ability. Some of the combinations of these schemes are effective while the others are not effective, as determined by experiments.

As to the surface energy of the intermediate belt, a series of extended researches and experiments showed that presuming various possible cases, it is extremely difficult to detect the excessive rise of the surface energy in terms of a preselected number of copies. This is because the amount of agent fed to the intermediate belt during the conditioning process and the increment of surface energy to occur between consecutive conditioning processes, i.e., the amount of agent shaved off in the transfer step and the amount of toner to deposit on the belt are not constant. Hence, when the surface energy lowering agent is fed to the belt in a great amount (or when the agent shaved off from the belt at the secondary transfer stage is small in amount, or when the toner deposited on the belt at the primary transfer stage is small in amount), defective transfer occurs during the primary transfer. When the agent fed to the belt is short (or when the agent shaved off from the belt during secondary transfer is small in amount, or when the toner deposited on the belt during primary transfer is small in amount, defective transfer occurs during the secondary transfer.

SUMMARY OF THE INVENTION

It is, therefore, an object of the present invention to provide an image forming apparatus capable of effectively reducing defective images locally lost in spots.

In accordance with the present invention, in an image forming apparatus of the type transferring a developed image carried on an image carrier to an endless intermediate transfer body by primary transfer, and then transferring the developed image to a transfer medium by secondary transfer, the intermediate transfer body has a surface tension greater than or equal to the surface tension of the image carrier in an actual operating condition.

Also, in accordance with the present invention, in an image forming apparatus of the type described, the intermediate transfer body has surface energy greater than or equal to the surface energy of the image carrier in an actual operating condition.

Further, in accordance with the present invention, in an image forming apparatus of the type described, an adhering force acting between the intermediate transfer body and the toner is greater than or equal to an adhering force acting between the toner and and the image carrier in an actual operating condition.

In addition, in accordance with the present invention, in an image forming apparatus of the type described, the image carrier has a linear velocity different from the linear velocity of the intermediate transfer body, but equal to the linear velocity of the transfer medium.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 8:
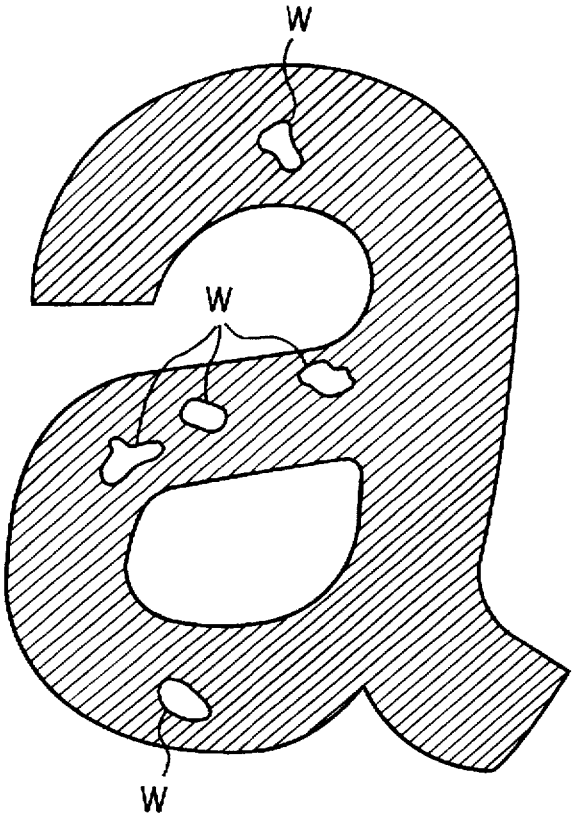
Fig. 8 PRIOR ART
FIG. 8 shows a specific image locally omitted in spots.

FIG. 8 shows a specific image transferred to a paper or similar transfer medium and locally lost in spots due to the defective primary and secondary image transfer as discussed earlier. As shown, when the image has a substantial area, it is partly lost with some areas w. In the case of a line image, it will be discontinuous due to the local omission.

Figure 9:
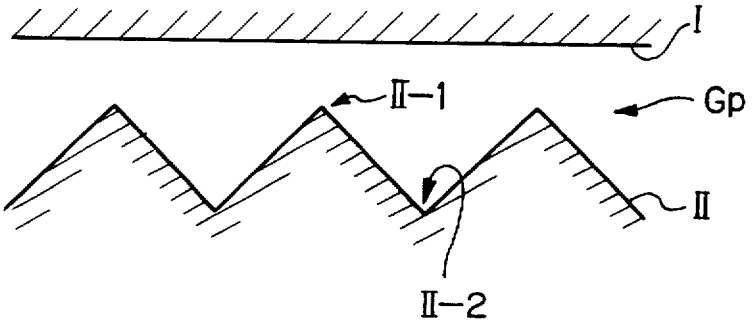
FIG. 9 shows a relation between the irregularity of the surface of the intermediate transfer belt and the transfer ability.

Assume that an intermediate transfer body has an extremely irregular or rough surface. Then, an electric field for image transfer acts on toner more intensity at the convex portions of the intermediate body than at concave portions. This will be described with reference to FIG. 9 specifically. As shown, assume an electrode I having a flat surface, and an electrode II facing the electrode I with the intermediary of a fine gap Gp and having a saw-toothed surface. Then, the electric field for toner transfer between a photoconductive element or image carrier and the intermediate body and the electric field between the intermediate body and the transfer medium may be represented by the following air gap fields:

primary transfer field: air gap field between image carrier and intermediate body secondary transfer field: air gap field between intermediate body and medium In FIG. 9, assume that the electrode II has a convex portion II-1 and a concave portion II-2. Then, when a bias voltage for image transfer is applied to the electrodes I and II, discharge concentrates on the convex portion II-1 which is closer to the electrode I than the concave portion II-2; that is, the air gap field is more intense at the convex portion II-1 than at the concave portion 11-2. For the same reason, when the intermediate body has a rough surface, the air gap field is more intense at convex portions than at concave portions.

Figure 10A:
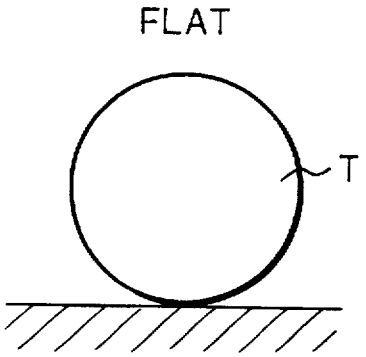
FIGS. 10A–10D also show a relation between the irregularity of the surface of the intermediate transfer belt and the transfer ability.
Figure 10B:
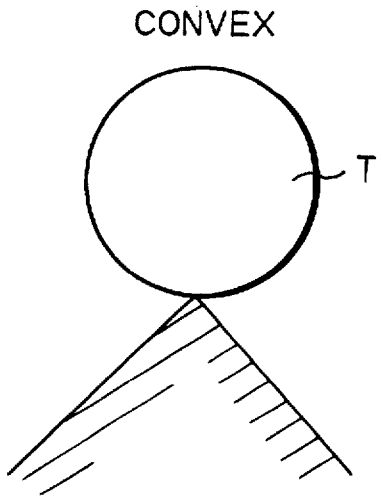
Figure 10C:
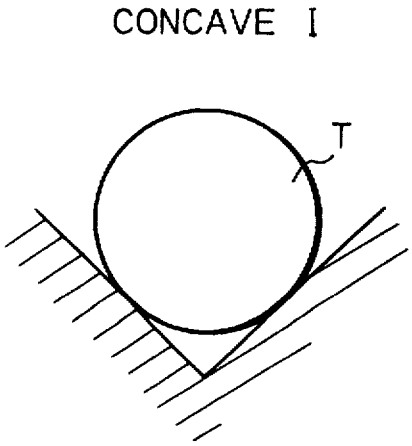
Figure 10D:
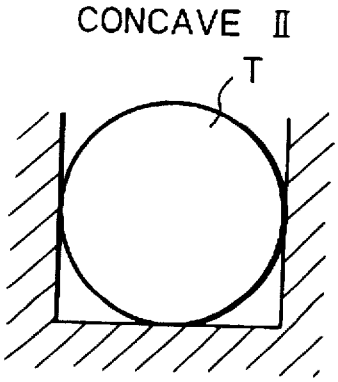

Assuming that toner particles present in the convex portion and concave portion have an identical shape, then the particle at the convex portion is subjected to a more intense field, i.e., a greater electrostatic force and transferred more easily than the particle at the concave portion. Stated another way, the particle at the concave portion cannot be easily transferred. Further, the particle positioned at the edge of the concave portion adheres to the intermediate body more intensely than the particle at the edge of the convex portion. This also prevents the particle at the concave portion from being easily transferred. Specifically, FIGS. 10A–10D each shows a single toner particle T contacting a surface indicated by hatching. The effective contact area of the particle T is greater in FIGS. 10C and 10D (concave surface) than in FIGS. 10A and 10B (flat surface and convex surface, respectively). So long as the particle T and the surface which it contacts are formed of the same material, van der Waals' forces act on the surface which the particle T adjoins (or contacts). Hence, the size of the effective contact surface is equivalent to the size of the adhering force. It follows that the adhering force of the particle T is greater at the concave portion than at the convex portion.

Preferably, therefore, the surface roughness of the intermediate body should be reduced up to a level at which the difference in transfer ability due to the irregularity of the surface is not critical. This is also true with a photoconductive element or image carrier. Providing image carrier with a preselected surface roughness in consideration of the transfer ability has been customary in the art, even with a selenium drum which is the oldest form of a photoconductive element. Therefore, adjusting the surface roughness of the intermediate body up to the level at which the above difference in transfer ability is not critical is meaningful for the prevention of the local omission of an image.

The present invention will be described in detail with reference to the accompanying drawings.

To begin with, a series of experiments were conducted by use of a color copier, which is a specific form of an image forming apparatus, and under various conditions in order to find conditions for reducing the local omission of an image.

Figure 1:
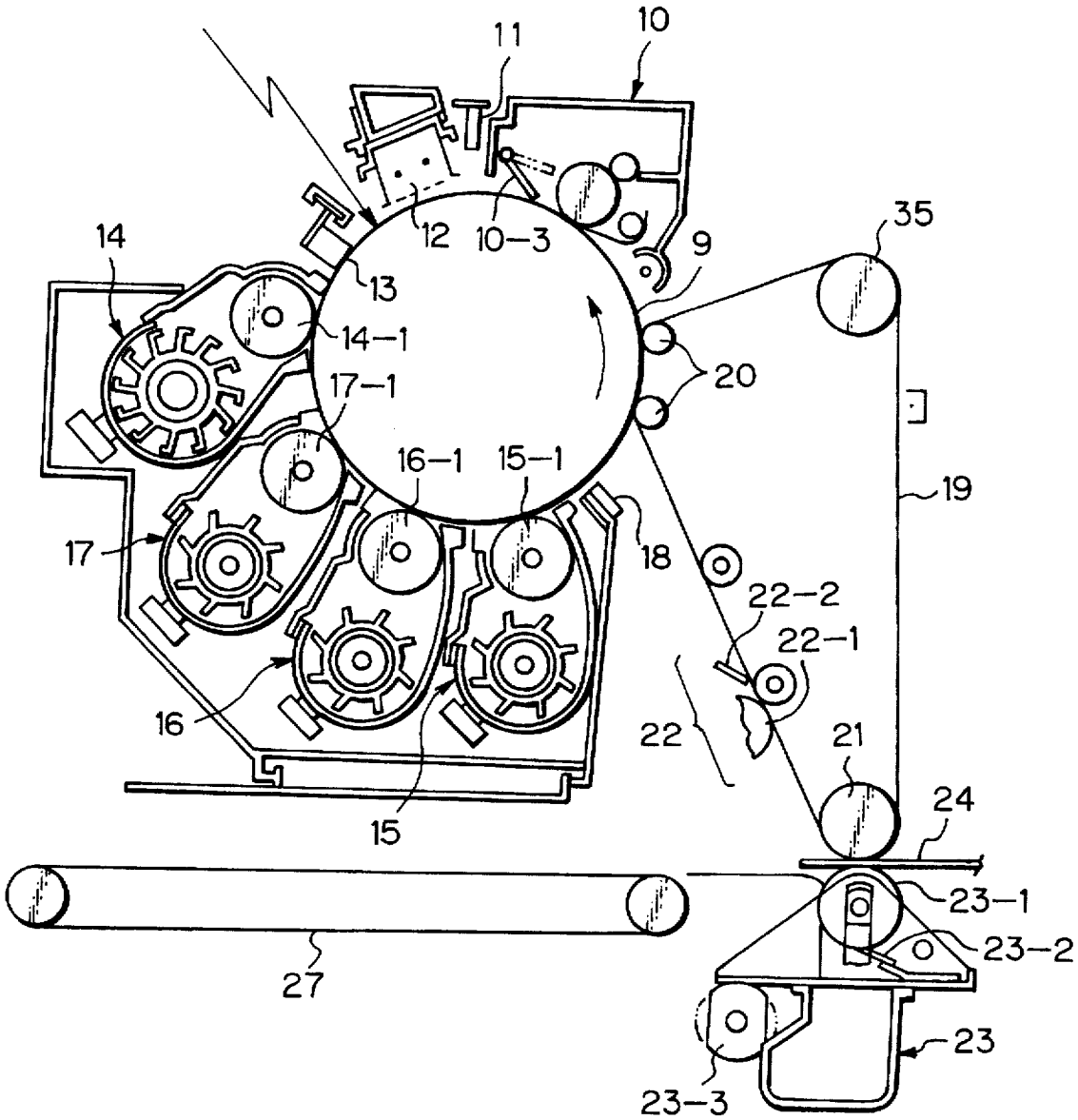
FIG. 1 is a fragmentary section of an image forming apparatus to which the present invention is applied and implemented as a color copier.

A reference will be made to FIGS. 1–3 for describing the construction of the color copier. FIG. 3 shows the overall arrangement of the copier while FIGS. 1 and 2 each shows a particular color image recording device included in the copier. The device of FIG. 2 includes a photoconductive element implemented as a drum 9, means for applying a lubricant 39 to a drum cleaning unit 10, and means for applying a lubricant 37 to an intermediate transfer belt 19. The device of FIG. 1 is similar to the device of FIG. 2 except that it lacks the means for applying the lubricants 39 and 37. While the intermediate body may be implemented as a drum, the following description will concentrate on the belt 19 by way of example.

As shown in FIG. 3, a color image reading device or color scanner 1 illuminates a document 3 with a lamp 4 and focuses the resulting imagewise reflection onto a color sensor 7 via mirrors 5-1, 5-2 and 5-3 and a lens 6. The color image information incident to the color sensor 7 is read color by color, i.e., red (R), green (G), and blue (B). The color information are each converted to a corresponding color signal by the color sensor 7. In the illustrative embodiment, the color sensor 7 is made up of R, G and B color separating means and a CCD (Charge Coupled Device) image sensor or similar photoelectric transducer, and reads the three colors at the same time. An image processor, not shown, transforms the R, G and B color signals to yellow (Y), magenta (M), cyan (C) and black (Bk) color image data on the basis of the intensity levels of the color signals. A color image recording device or color printer 2 produces Bk, C, M and Y toner images on the basis of the color image data. The toner images of different colors are superposed one upon the other to turn out a four-color or full-color image.

Specifically, as shown in FIG. 3, an optical writing unit 8 transforms each color image data input from the color scanner 1 to an optical signal and then optically writes a corresponding image on the drum 9 for thereby electrostatically forming a latent image. The writing unit 8 has a laser 8-1, a laser driver, not shown, a polygonal mirror 8-2, a motor 8-3 for driving the mirror 8-2, an f-theta lens 8-4, and a mirror 8-5.

The drum 9 is rotated counterclockwise, as indicated by an arrow in the figures. Arranged around the drum 9 are the previously mentioned drum cleaning unit (including a pre-cleaning discharger) 10, a discharge lamp 11, a charger 12, a potential sensor 13, a Bk developing unit 14, a C developing unit 15, an M developing unit 16, a Y developing unit 17, a density pattern sensor 18, and the belt 19. As shown in FIG. 2, the developing units 14–17 respectively have developing sleeves 14-1, 15-1, 16-1 and 17-1, paddles 14-2, 15-2, 16-2 and 17-2, and toner concentration sensors 14-3, 15-3, 16-3 and 17-3. The sleeves 14-1 through 17-1 are each rotatable to bring a developer of particular color into contact with the drum 9 for developing a latent image. The paddles 14-1 through 17-2 are each rotatable to scoop up the associated developer while agitating it. In a standby condition, all the developing units 14–17 hold their sleeves 14-1 through 17-1 in an inoperative condition. The operation of the copier will be described on the assumption that images are sequentially formed in the order of, but not limited to, Bk, C, M and Y.

First, the color scanner 1 starts reading Bk image data at a predetermining time. At the same time, the drum 9 is rotated counterclockwise by a drive mechanism, not shown in FIG. 2, and uniformly charged by the charger 12. The writing unit 8 starts forming a latent image on the drum 9 in response to the Bk image data. Let the latent image derived from the Bk image data be referred to as a Bk latent image for simplicity. This is also true with latent images to be derived from C, M and Y image data. In order to develop the Bk latent image from the leading edge thereof, the sleeve 14-1 begins to be rotated before the leading edge of the latent image arrives at a Bk developing position assigned to the Bk developing unit 14. As a result, the sleeve 14-1 develops the Bk latent image with Bk toner. As soon as the trailing edge of the Bk latent image moves away from the Bk developing position, the developer deposited on the sleeve 14-1 is brought to an inoperative position. This is completed at least before the leading edge of the next or C latent image arrives at the Bk developing position. To bring the developer to the inoperative position, the rotation of the sleeve 14-1 is reversed.

A Bk toner image formed on the drum 9 by the above procedure is transferred to the surface of the belt 19 which is moving at the same speed as the drum 9. The transfer of a toner image from the drum 9 to the belt 19 will be referred to as primary transfer hereinafter. For the primary transfer, a predetermined bias voltage is applied to a bias roller 20, which will be described, while the drum 9 and belt 19 are held in contact with each other. The Bk, C, M and Y toner images sequentially formed on the drum 9 are sequentially transferred to the belt 19 one above the other. The resulting four-color or full-color image is bodily transferred to a paper, or transfer medium, 24 (see FIG. 3). Let the transfer of the full-color image from the belt 19 to the paper 24 be referred to as secondary transfer hereinafter.

Specifically, after the Bk image forming step, the color scanner 1 starts reading C image data at a predetermined time. A C latent image represented by the C image data is formed on the drum 9 by a laser beam. After the trailing edge of the first or Bk latent image has moved away from a C developing position assigned to the C developing unit 15, but before the trailing edge of the C latent image arrives thereat, the developing unit 15 starts rotating the sleeve 15-1 so as to bring C toner to an operative position on the sleeve 15-1. As a result, the C latent image is developed by the C toner. As soon as the trailing edge of the C latent image moves away from the C developing position, the developer on the sleeve 15-1 is brought to an inoperative position, as in the Bk developing unit 14. This is also completed before the trailing edge of the next or M latent image arrives at the C developing position. An M and a Y image forming step are similar to the above Bk and C image forming steps and will not be described in order to avoid redundancy.

Figure 2:
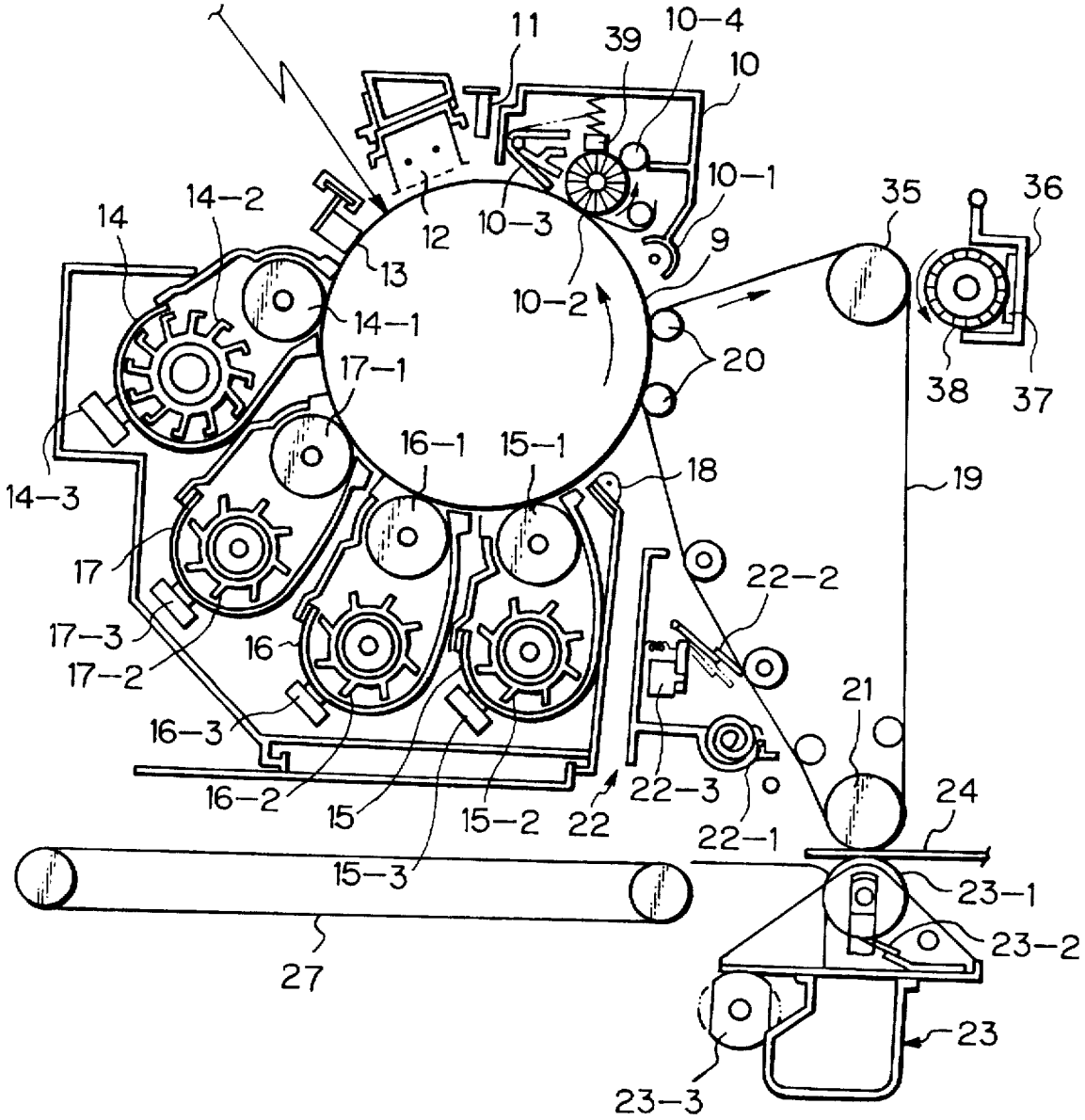
FIG. 2 is a fragmentary section showing another color copier.
Figure 3:
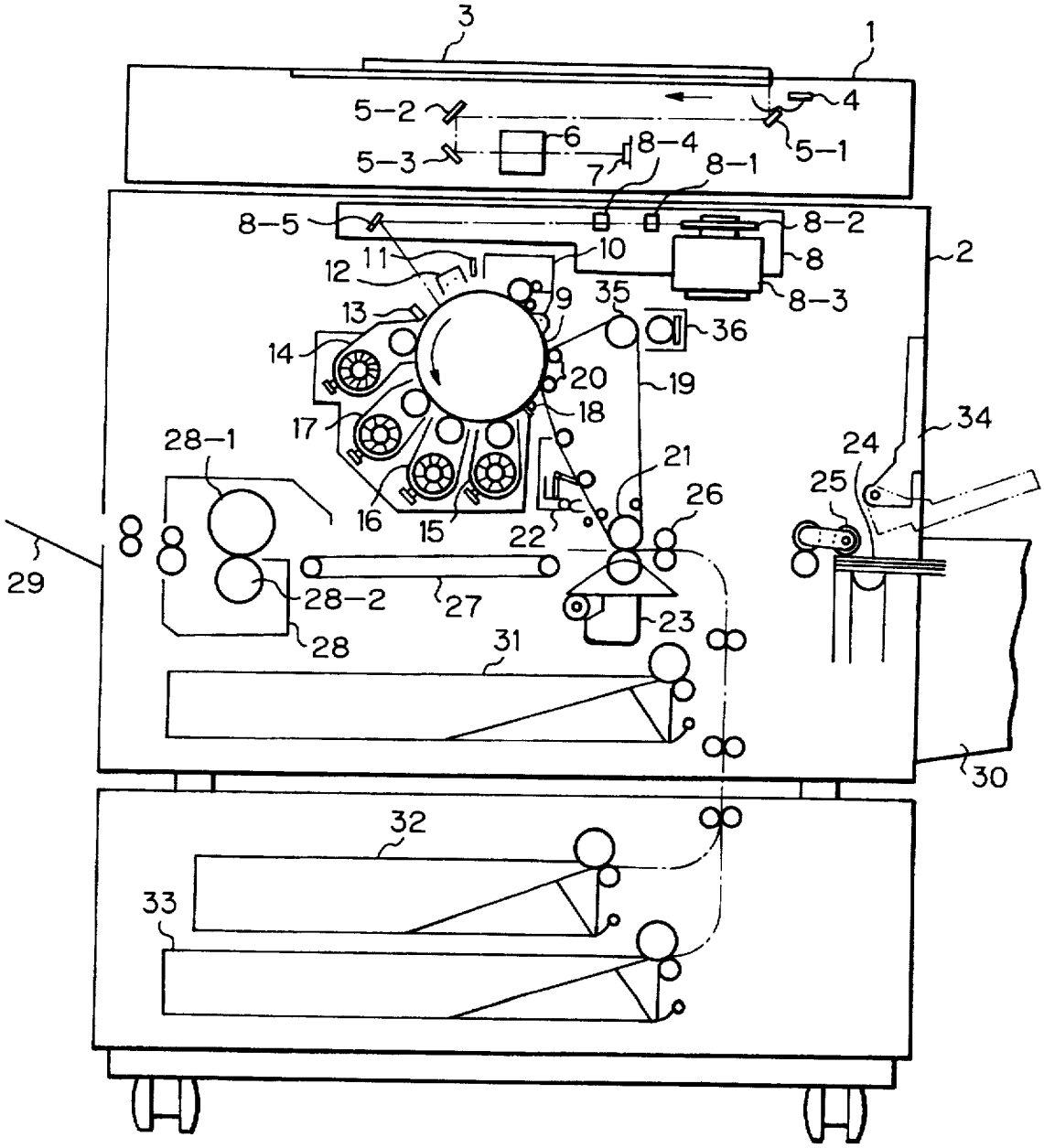
FIG. 3 is a section showing the general configuration of the copier shown in FIG. 1 or 2.

As shown in FIG. 2, the belt 19 is passed over the previously mentioned bias roller 20, a drive roller 21, and a plurality of driven rollers. The belt 19 is pressed against the drum 9 via the bias roller 20; and adequate degree of pressure acts at the nip between the belt 19 and the drum 9. A motor, not shown, is drivably connected to the drive roller 21.

A belt cleaning unit 22 has a brush roller 22-1, a rubber blade 22-2, and a mechanism 22-3 for moving the unit 22 into and out of contact with the belt 19. During the primary transfer of the C, M and Y toner images to the belt 19, the mechanism 22-3 maintains the cleaning unit 22 spaced from the belt 19.

A paper transfer unit 23 for the secondary transfer of the full-color image has a bias roller 23-1, a roller cleaning blade 23-2, and a mechanism 23-3 for moving the bias roller 23-1 into and out of con tact with the belt 19. Usually, the mechanism 23-3 maintains the cleaning blade 23-2 spaced from the belt 19. In the event when the full-color image is transferred from the belt 19 to the paper 24, the mechanism 23-3 presses the bias roller 23-1 against the belt 19. At the same time, a preselected bias voltage is applied to the bias roller 23-1.

The paper 24 i s fed by a feed roller 25 and once stopped by a registration roller 26. The registration roller 26 again drives the paper 24 at a predetermining timing such that the leading edge of the paper 24 meets the leading edge of the image carried on the belt 19. As a result, the image is transferred from the belt 19 to the paper 24 at the nip between the drive roller 21 and the bias roller 23-1 (secondary transfer). The paper 24 carrying the image thereon is conveyed to a fixing unit 28 by a belt 27. After the image has been fixed on the paper 24 by the fixing unit 28, the paper or copy 24 is driven out to a tray 29.

After the primary transfer of the first or Bk toner image from the drum 9 to the belt 19, the belt 19 may be moved in any one of the following three different modes. If desired, the three modes to be described may be adopted in an efficient combination, depending on the copy size, copy speed, etc.

[I] Constant Speed Forward Mode (1) Even after the primary transfer of the Bk image, the belt 19 is continuously moved forward at the same speed.

(2) The C toner image is formed on the drum 9 such that when the position on the belt 19 where the leading edge of the Bk image is located again arrives at the drum 9, the leading edge of the C toner image meets the above position of the belt 19. As a result, the C image is transferred to the belt 19 in accurate register with the Bk image.

(3) Subsequently, the M and Y images are sequentially formed on the drum 9 and transferred to the belt 19 to complete a full-color image.

(4) After the transfer of the Y or last image to the belt 19, the belt 19 is continuously moved forward to transfer the full-color image to the paper 24, as stated earlier.

[II] Skip Forward Mode (1) After the primary transfer of the Bk image, the belt 19 is moved away from the drum 9, caused to skip forward at a high speed, and then restored to the original speed on moving a predetermined distance. Then, the belt 19 is again brought into contact with the drum 9.

(2) When the leading edge of the Bk image on the belt 19 again arrives at the drum 9, it meets the leading edge of the C toner image formed on the drum 9. As a result, the C image is transferred to the belt 19 in accurate register with the Bk image.

(3) Subsequently, the M and Y images are sequentially formed on the drum 9 and transferred to the belt 19 in the same manner in order to complete a full-color image.

(4) After the transfer of the Y or last image to the belt 19, the belt 19 is moved forward at the same speed to transfer the full-color image to the paper 24.

[III] Reciprocation (Quick Return) Mode (1) After the primary transfer of the Bk image, the belt 19 is moved away from the drum 9, brought to a stop, and then driven in the reverse direction at a high speed. Consequently, the leading edge of the Bk image on the belt 19 passes through the nip between the belt 19 and the drum 9 in the reverse direction. On moving a predetermined distance in the reverse direction, the belt 19 is brought to a stop.

(2) When the leading edge of the C toner image on the drum 9 arrives at a preselected position short of the nip between the drum 9 and the belt 19, or belt transfer position, the belt 19 is again moved forward and again brought into contact with the drum 9. The C image is transferred from the drum 9 to the belt 19 in accurate register with the Bk image.

(3) Subsequently, the M and Y images are sequentially formed on the drum 9 and transferred to the belt 19 in the same manner in order to complete a full-color image.

(4) After the transfer of the Y or last image to the belt 19, the belt 19 is continuously moved forward at the same speed without being returned. As a result, the full-color image is transferred from the belt 19 to the paper 24.

The paper 24 carrying the full color image transferred by any of the above different modes is conveyed to the fixing unit 28 by the belt 27. The fixing unit 28 fixes the image on the paper 24 with a heat roller 28-1 controlled to a predetermined temperature and a press roller 28-2. Then, the paper or full-color copy 24 is driven out to the tray 29. After each primary transfer, the drum 9 has its surface cleaned by the drum cleaning unit 10 and then uniformly discharged by the discharge lamp 11.

After the full-color image has been transferred from the belt 19 to the paper 24, the surface of the belt 19 is cleaned by the belt cleaning unit 22 pressed against it by the mechanism 22-3. In a repeat copy mode, the step of forming the first Y (fourth color) image is followed by the step of forming the second Bk (first color) image. Also, after the transfer of the first full-color image to the paper 24, the second Bk toner image is transferred to the portion of the belt 19 which has been cleaned by the belt cleaning unit 22. This is followed by the same procedure as described in relation to the first paper 24.

As shown in FIG. 3, paper cassettes 30, 31, 32 and 33 are each loaded with a stack of papers of particular size. When one of the cassettes 30–33 is selected on an operation panel, not shown, the papers are sequentially fed from the cassette selected toward the registration roller 26. The reference numeral 34 designates a manual feed tray available for feeding overhead projector sheets or relatively thick sheets by hand.

In a three- or two-color copy mode, as distinguished from the four-color copy mode described above, the above procedure is repeated a number of times corresponding to designated colors and the desired number of copies. In a single color copy mode, one of the developing units 14–17 matching the desired color is held operative until a desired number of copies have been produced. At the same time, the belt 19 is moved forward at a constant speed in contact with the drum 9 while the belt cleaning unit 22 is held in contact with the belt 19.

A preferred embodiment of the present invention is implemented under the following conditions:

Drum 9: OPC (Organic Photo Conductor)

Belt 19: carbon-dispersed fluorine-contained resin Pn=$10^{10}$ Ωcm, Ps=$10^{9}$ Ωcm Bias roller 23-1: hydrine rubber roller covered with PFE tube Pn=$10^{9}$ Ωcm polyol (main resin) colored by carbon for black or pigments for magenta and yellow; silica added to outer periphery Developer: toner concentration of 4 to 6 wt % for each color charge of −15 to −15 μc/g for each color Drum potential: −80 to −130 V for image portion (LD data of "255") or −500 to −700 V for background (LD data of "0")

Experiments were conducted to determine conditions under which the local omission of an image occurs, and conditions for obviating it, as follows.

Among the prior art schemes [I]–[IV] discussed earlier, the schemes [I]–[III] were evaluated as to the local omission of an image with the following fixed conditions and by using the surface tension of the belt 19 as a parameter:

Condition 1: belt 19 surface roughness ranging from 0.6 to 0.9 (10-point mean roughness as prescribed by JIS (Japanese Industrial Standards) B0601)

Condition 2: difference in linear speed drum 9 ($V_F$)/belt 19 ($V_B$) . . . 1.1 belt 19 ($V_B$)/paper 24 ($V_P$) . . . 0.91

Condition 3: nip pressure between drum 9 and belt 19 . . . 125 g/cm$^2$ between belt 19 and paper 24 . . . 250 g/cm$^2$ Condition 4: drum of PRETER 550 (trade name; photoconductor available from Ricoh and with zinc stearate applied as lubricant)

Condition 5: developer Type E (trade name; available from Ricoh)

The copier shown in FIGS. 1 and 3 was operated to produce images under the above conditions 1–5 so as to determine the local omission of an image. The results of evaluation and the steps at which the local omission occurred are listed in Table 1 below.

TABLE 1

| Intermediate Transfer Body | | | | Local Omission | |
|---|---|---|---|---|---|
| Resin | Lubricant | Surface Tension (dyn/cm) | Adhesion (cN) | Rank | Stage |
| ETFE | applied | 15 | 3 | 1 | primary |
| | not applied | 24 | 7 | 3 | primary |
| PVdF | applied | 19 | 5 | 2 | primary |
| | not applied | 28 | 8 | 3 | primary |
| PET | applied | 21 | 8 | 3 | primary |
| | not applied | 33 | 18 | 5 | none |
| PC | applied | 30 | 7 | 4 | primary |
| | not applied | 41 | 20 | 5 | none |
| ABS | applied | 38 | 50 | 5 | none |
| | not applied | 52 | 100 | 2 | secondary |

In Table 1, ETFE stands for ethylene-tetrafluoroethylene copolymer and is implemented by Neoflon (trade name; available from Daikin Kogyo), PVdF stands for polyvinylidene fluoride and is implemented by Kynar 820 (trade name; available from Penwal), PET stands for polyethylene terephthalate and is implemented by FR-PET (trade name; available from Teijin), PC stands for polycarbonate and is implemented by Panlite K1300 (trade name; available from Teijin), and ABS stands for acrylonitrile-butadien-styrene copolymer (ABS) and is implemented by Toyorack Parel (trade name; available from Toray).

For the above experiments, use was made of intermediate transfer belts which were seamless belts produced by the extrusion of carbon-dispersed polycarbonate (PC) and having a resistance ranging from $10^{11}$ to $10^{12}$ Ωcm. Coating liquids were prepared by dispersing carbon in each of the resins listed in Table 1 such that they would have a specific resistance ranging from $10^{11}$ to $10^{12}$ Ωcm when applied and then dried. The coating liquids were each applied to one of the seamless belts by spraying such that it would form a 20 μm film when dried. The local omission of an image was evaluated by eye in five consecutive ranks; rank 5 and rank 1 were best and worst, respectively, while the intervening ranks were medium.

Table 2 shown below lists the results of Table 1 in respect of the surface tension and local omission characteristic.

TABLE 2

| Local Omission Rank | 1 | 2 | 3 | 4 | 5 |
|---|---|---|---|---|---|
| Surface Tension (dyn/cm) | 15 | 19, 52 | 21, 24, 28 | 30 | 33, 38, 41 |

In Table 2, ranks 5–1 are representative of the following conditions:
Rank 5: no local omission
Rank 4: local omission although not visible, acceptable in about more than 80%
Rank 3: visible local omission, acceptable in about 50%
Rank 2: visible local omission, acceptable in about 20%
Rank 1: visible local omission, not acceptable at all Rank 3 and below are considered to be defective; rank 4 and above are the target.

As Table 2 indicates, the idea that for the desirable image transfer (including local transfer) the surface tension of the intermediate transfer body and the contact angle should preferably be great and small, respectively, is not correct.

Table 3 shown below lists the results of Table 1 in respect of the step where the local omission occurred (primary or secondary transfer) and the surface tension of the intermediate body.

TABLE 3

| Stage | primary transfer | secondary transfer | none |
|---|---|---|---|
| Surface Tension (dyn/cm) | 15, 19, 21 24, 28, 30 | 52 | 33, 38, 41 |

As Table 3 indicates, the local omission occurs at the primary transfer stage when the surface tension of the intermediate body is small or at the secondary transfer stage when it is great. Also, it will be seen that the local omission does not occur when the surface tention is medium.

Table 3 indicates that the local omission occurs at the primary transfer stage if the surface tension is small or occurs at the secondary transfer stage if it is great. Table 3 also shows that the local omission does not occur when the surface tension lies between the above great tension and the small tension.

The photoconductive element used for the experiments was measured to have a surface tension of 30 dyn/cm. This, coupled with the results shown in Table 3, indicate that the surface tension of the intermediate body is smaller than that of the photoconductive element or image carrier, and that the adhering force of the toner to the image carrier or how easily the former adheres to the latter is greater than the adhering force of the toner to the intermediate body. This brings about an occurrence that the electrostatic transfer from the image carrier to the intermediate body is obstructed, or that the toner once deposited on the latter is again transferred to the former, resulting in a locally limited image at the primary transfer stage.

The surface tension may be regarded as a force tending to pull apart the deposited toner or a physical quantity representative of how easily the toner adheres. Hence, if the surface tensions of the image carrier and intermediate body or those of the intermediate body and transfer medium are equal, the adhering force of the toner between them or the easiness of toner adhesion does not act in a direction in which the electrostatic force derived from the transfer electric field is deteriorated. It follows that if the surface tension of the intermediate body is greater than or equal to the surface tension of the image carrier, the local omission of an image is reduced. Specifically, when the image carrier has the previously mentioned surface tension of 30 dyn/cm, the intermediate body should preferably have a surface tension equal to or greater than 30 dyn/cm, more preferably greater than 30 dyn/cm, as determined by experiments. The transfer medium or paper used for the experiments had a surface tension of 42 dyn/cm (measured value). Cellulose has a surface potential of about 35 to 45 dyn/cm, according to Polymer Handbook.

It was, therefore, found that more desirable primary a n d secondary transfer is achievable when the intermediate body has a surface tension equal to or greater than 30 dyn/cm, but smaller than 42 dyn/cm. For this reason, the present invention provides the intermediate body with a surface tension smaller than 41 dyn/cm, inclusive of 41 dyn/cm.

As for the secondary transfer, the local omission of an image occurs when the surface tension of the intermediate body exceeds the surface tension of the transfer medium, as customarily accepted. Hence, the local omission can be reduced if the surface tension of the intermediate body is smaller than the surface tension of the transfer medium.

Thus, under the actual conditions for image formation, there is satisfied, as for the primary transfer, the condition that the surface tension of the intermediate body (30 to 41 dyn/cm be greater than or equal to the surface tension of the photoconductive element or image transfer (30 dyn/cm), more preferably that the former (33 to 41 dyn/cm) be greater than the latter (30 to 41 dyn/cm). As a result, the local omission in the primary transfer is eliminated or reduced. The improved primary transfer contributes to the improvement in the secondary transfer and thereby obviates the local omission.

Taking account of the conditions for the secondary transfer also, it is important to satisfy the condition that the surface tension of the intermediate body (30 to 41 dyn/cm) be greater than or equal to the surface tension of the image carrier (30 dyn/cm), but smaller than or equal to the surface potential of the transfer medium, more preferably that the surface tension of the intermediate body (33 to 41 dyn/cm) be greater than the surface tension of the image carrier (30 dyn/cm). This will be apparent from the combinations of (PET, lubricant applied), (PC, lubricant applied and not applied), and (ABS, lubricant applied) included in Table 1.

If the above conditions are satisfied, locally omitted images are obviated. Such conditions must also be satisfied in order to eliminate locally omitted images due to aging. Specifically, even when the desired conditions are satisfied at the initial stage, it is likely that the relation between the image carrier and the intermediate body is lost due to aging, e.g., toner filming, resulting in defective transfer. Hence, the above relations must be satisfied during actual operation, i.e., whenever the copier is operated to form an image.

For the above purpose, the image carrier and intermediate body are made of materials which satisfy the above relations over a long period of time. Alternatively, as shown in FIG. 2, while the copier is in operation, a brush roller 10-2 may apply the flat lubricant 39 of zinc stearate to the drum 9 while a brush 38 may apply the flat lubricant 37 of zinc stearate to the belt 19. In this case, the amounts of application by the brush roller 10-2 and brush 38 for a unit time are adjusted. In any case, the above relation is held between the surface energy of the drum 9 and that of the belt 19 despite aging. How the brush roller 10-2 and brush 38 apply the lubricants 39 and 37, respectively, will be described in detail later.

A series of extended researches and experiments showed that the local omission of an image is presumably related not only to the surface tensions but also to the surface roughness of the intermediate body, pressure acting at the nip for image transfer, difference in linear speed between the transfer members, frictional charging characteristic between the transfer members and the toner, etc. These factors are considered to more or less effect the local omission of an image.

It was also found by experiments that images are free from local omission if an adhering force acting between the toner and the intermediate body is greater than or equal to an adhering force acting between the toner and the image carrier in the actual operating conditions, or if the force acting between the toner and the intermediate body is greater than or equal to the force between the toner and the image carrier, but smaller than or equal to the force between the toner and the transfer medium under the actual operating conditions.

The words "adhering force" refer to the sum of electrostatic adhesion, van der Waals' forces, and chemical and mechanical adhesion to occur under the conditions for measurement. Chemically, a part of the adhering force may be represented by a surface tension or similar characteristic value. The most effective measure to reduce the adhering force is reducing the surface tension.

Generally, the transfer ability decreases with an increase in the adhering force between the toner and a member on which it is deposited. Therefore, in order to achieve the object of the present invention, it is necessary to reduce such an adhering force. However, when it comes to an image forming apparatus of the type effecting primary transfer and secondary transfer, the local omission of an image cannot be avoided if the adhering force between the toner and the member carrying it is simply reduced.

The transfer of toner from the image carrier to the intermediate body and from the intermediate body to the transfer medium is effected by an electric field. As for the transfer from the image carrier to the intermediate body, for example, even if the adhering force between the image carrier and the toner is small, the toner easily adheres to the image carrier if the adhering force between the intermediate body and the toner is smaller. As a result, the toner partly remains on the image carrier without being transferred to the intermediate body. This causes the image to be locally lost at the primary transfer stage. This is also true with the secondary transfer to occur between the intermediate body and the transfer medium.

While the adhering force acting between the toner and the member carrying it is defined by a measuring method which will be described, it is not the force of the individual toner particle, but it is a statistical value (mean value). If the adhering force between the toner and the intermediate body is greater than or equal to the adhering force between the toner and the image carrier, the local omission at the primary transfer stage can be obviated. The improved primary transfer improves even the secondary transfer and thereby eliminates the local omission. Taking account of the conditions for the secondary transfer also, it is also important that the adhering force between the toner and the intermediate body be greater than or equal to the adhering force between the toner and the image carrier, but smaller than or equal to the adhering force between the toner and the transfer medium.

For the measurement of the adhering force, use may be made of a method using a centrifugal force, as taught in, e.g., the Journal of Electrophotographic Engineers of Japan, Vol. 34, No. 2, page 84. This method will be described hereinafter with reference to FIG. 12.

Figure 12:
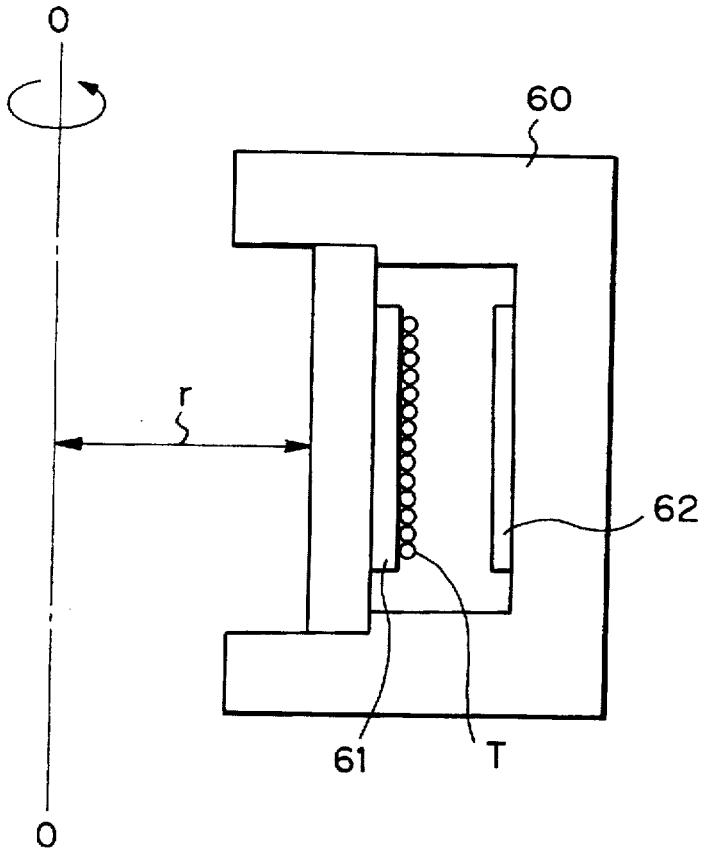
FIG. 12 shows a specific arrangement for measuring the adhering force of toner.

As shown in FIG. 12, a sample holder 60 revolves around the axis O—O of a rotor. The sample holder 60 has a bed 61 on which toner T is deposited, and a flat toner catcher 62 outboard of the bed 61. The bed 61 is implemented by the material of the drum 9, belt 19, or paper 24 on which toner should be deposited. For the toner T, use was made of PRETER 550 having a particle size of 7.5 μm. The distance r between the axis of rotation O—O and the surface of the bed 61 where the toner T was deposited was 8 cm. When the sample holder 60 revolves around the axis O—O, the toner T flies off the bed 61 with the result that the amount of toner on the bed 61 decreases. The revolution speed of the sample holder 60 was measured when the amount of toner remaining on the bed 61 was reduced to 50%. An adhering force F is expressed as:

$$F=m\cdot r(2\cdot\pi\cdot R) \quad \text{(unit: nN)}$$

where m is the weight of the toner T caught by the catcher 62, R is the above revolution speed of the sample holder 60, and r is the revolution speed of the sample.

The measurement showed that the adhering force between the drum 9 and the toner T is 15 nN. Hence, it will be seen that the adhering force between the belt 19 and the toner is 3 to 100 nN, and that the adhering force between the paper 24 and the toner is 50 nN, as also indicated by Table 1. Hence, when the adhering force between the intermediate body and the toner is 18 nN, 20 nN or 50 nN which satisfies the condition that the adhering force between the intermediate body and the toner be greater than or equal to the force between the image carrier and the toner, but smaller than or equal to the force between the transfer medium and the toner, the local omission of an image does not occur at rank 5. When the force is 100 nN which does not satisfy the above condition, the result is as low as rank 2 at the secondary transfer state.

Further, when the adhering force between the intermediate body and the toner is 2 nN, 7 nN, 5 nN or 8 nN not satisfying the above condition, the result is of low rank at the primary transfer stage. Hence, as for the primary transfer, it is important to satisfy the condition that the force between the intermediate member and the toner be greater than or equal to the force between the image carrier and the toner. The improvement in primary transfer contributes to the improvement in secondary transfer. Further, taking account of the secondary transfer also, it is necessary to satisfy the condition that the adhering force between the intermediate body and the toner be greater than or equal to the force between the image carrier and the toner, but smaller than or equal to the force between the transfer medium and the toner.

If the above conditions are satisfied, locally omitted images are obviated. Such conditions must also be satisfied in order to eliminate locally omitted images due to aging. Specifically, even when the desired conditions are satisfied a t the initial stage, it is likely that the relation between the image carrier and the intermediate body is lost due to aging, e.g., toner filming, resulting in defective transfer. Hence, the above relations must be satisfied during actual operation, i.e., whenever the copier is operated to form an image.

For the above purpose, the image carrier and intermediate body are made of materials which satisfy the above relations over a long period of time. Alternatively, as shown in FIG. 2, while the copier is in operation, a brush roller 10-2 applies the flat lubricant 39 of zinc stearate to the drum 9 while a brush 38 applies the flat lubricant 37 of zinc stearate to the belt 19. The amounts of application by the brush roller 10-2 and brush 38 for a unit time are adjusted. In any case, the above relation is held between the surface energy of the drum 9 and that of the belt 19 despite aging. How the brush roller 10-2 and brush 38 apply the lubricants 39 and 37, respectively, will be described in detail later.

Experiments further showed that the local omission of a n image can be eliminated if the linear velocity of the intermediate body is not equal to the linear velocity of the image carrier, and if the linear velocity of the intermediate body is equal to the linear velocity of the transfer medium, as will be described. While some different measures have already been proposed against the local omission of an image, the previously discussed measure [II], i.e., a difference in linear velocity between the transfer members, including the transfer medium, is effective.

Figure 11A:
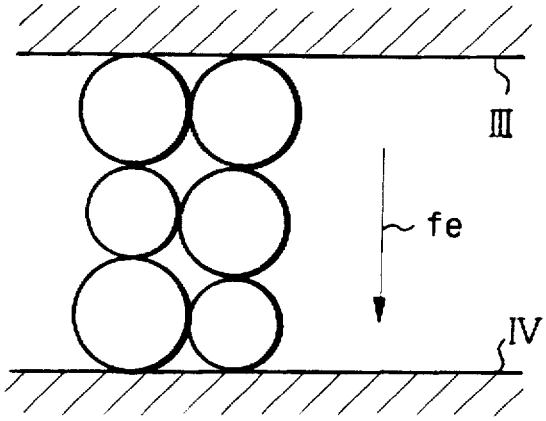
FIGS. 11A and 11B show a relation between the linear velocity of a transfer member and the transfer ability.
Figure 11B:
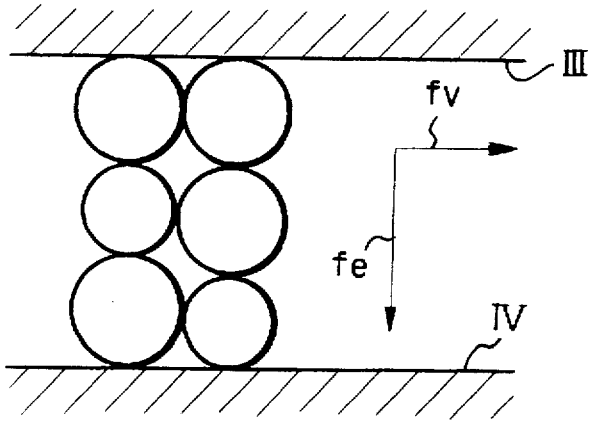

Specifically, FIGS. 11A and 11B show a member III carrying toner, and a member V to which the toner is to be transferred from the member III. Assume that when the member III is the image carrier, the member IV is the intermediate body while, when the former is the intermediate body, the latter is the transfer medium. FIG. 11A shows a condition wherein the linear velocity ratio between the members III and IV is 1, i.e., the members III and IV are moved at the same linear velocity. In this condition, only an electrostatic force fe (=q·E where q and E are respectively the charge (μC) of the toner T and the electric field) acts on the toner T due to the electric field for transfer. By contrast, as shown in FIG. 11B, when the linear velocity of the member III and that of the member IV are different, a shearing force fv is added to the electrostatic force fe. The shearing force fv tends to release to the toner T from the adhering force acting between the members III and IV and attributable to van der Waals'forces, among others. Hence, it may be safely considered that the electrostatic force fe transfers the toner T to the member IV more easily in the condition of FIG. 11B than in the condition of FIG. 11A.

In light of the above, it is desirable that the linear velocity of the image carrier and that of the intermediate body be different from each other, and that the linear velocity of the intermediate body and that of the transfer medium be different from each other. However, when the intermediate body is moved at a higher or lower linear velocity than the image carrier at the primary transfer stage, the image transferred from the image carrier to the intermediate body is expanded or contracted. This requires extra image processing for the correction of the expanded or contracted image.

To free the image from the above expansion o r contraction without resorting to extra image processing, the image carrier and the transfer medium are moved at the same linear velocity at the primary and secondary transfer stages, and the intermediate body is accelerated or decelerated relative to the image carrier or the transfer medium. Hence, the linear velocity of the intermediate body is different from the linear velocity of the image carrier. As a result, the image once expanded or contracted at the primary transfer stage is contracted or expanded at the secondary transfer stage in the same ratio as during the primary transfer. This successfully reproduces the same image as the image formed on the image carrier and thereby obviates local omission without resorting to the extra image processing.

Further, if the condition that the linear velocity of the image carrier and that of the transfer body be different from each other is satisfied in addition to the condition that the surface tension of the intermediate body be greater than or equal to the surface tension of the image carrier, the local omission of an image can also be obviated, as determined by experiments. This is to more surely eliminate the local omission by further limiting the conditions.

Moreover, if the condition that the surface tension of the intermediate body be greater than or equal to the surface tension of the image carrier, but smaller than or equal to the surface tension of the transfer medium, and the condition that the linear velocity of the intermediate body be equal to the linear velocity of the transfer medium are satisfied in addition to the condition that the surface tension of the intermediate body be greater than the surface tension of the image carrier, but smaller than or equal to the surface tension of the transfer medium, the local omission of an image can also be obviated, as determined by experiments. For the elimination of the local omission, it is important that the surface tension of the intermediate body be equal to or greater than the surface tension of the image carrier, but smaller than or equal to the surface tension of the transfer medium, as stated previously. The difference in linear velocity between the transfer members is also important, as discussed earlier. However, when the intermediate body is moved at a higher or lower linear velocity than the image carrier at the primary transfer stage, the image transferred from the image carrier to the intermediate body is expanded or contracted, as stated earlier. This requires extra image processing for correcting the expanded or contracted image. To free the image from the above expansion or contraction without resorting to extra image processing, the image carrier and the transfer medium are moved at the same linear velocity, and the transfer body is accelerated or decelerated relative to the image carrier or the transfer medium. As a result, the image once expanded or contracted at the primary transfer stage is contracted or expanded at the secondary transfer stage in the same ratio as during the primary transfer. This successfully reproduces the same image as the image formed on the image carrier and thereby obviates local omission without resorting to the extra image processing. Of course, the surface tension of the intermediate body is selected to be equal to the surface tension of the transfer medium.

Another prerequisite for the elimination of the local omission is that the surface energy of the intermediate body is greater than or equal to the surface energy of the image carrier. When it comes to a pure substance, the surface tension is equivalent to the surface energy in meaning. Generally, the surface tension of a substance, whether it be pure or not, is dealt with as a substitute for the surface energy like wettability. Hence, the local omission can also be obviated if there holds a condition that the surface energy of the intermediate body be greater than or equal to the surface energy of the image carrier.

In accordance with the present invention, a lubricant is applied to the surface of the image carrier in order to lower the surface energy thereof. This is one of implementations for satisfying the condition that the surface energy of the intermediate body be greater than or equal to the surface energy of the image carrier. Generally, the image carrier is formed of a polycarbonate resin in order to obtain the required characteristics including the electrostatic and mechanical characteristics and durability. By contrast, a broad range of materials are available for the intermediate body; use is made of fluorine-contained resin having small surface energy.

When the intermediate body is made of a material having small surface energy, the surface energy is smaller than the surface energy of the image carrier and that of the transfer medium. This brings about the local omission of an image at the primary transfer stage, setting aside the secondary transfer stage. That is, whatever the material of the intermediate body may be, the condition that the surface energy thereof be greater than or equal to the surface energy of the image carrier cannot be satisfied unless a lubricant is applied to the image carrier.

The amount of lubricant to be applied to the image carrier should be reduced as far as possible within a range which satisfies the above condition, because excessive amounts of lubricant would have an adverse effect. Because the lubricant is applied via a brush or by being pressed against the image carrier, the amount of application for a unit time is controlled in terms of the rotation speed of the brush or the contact pressure of the lubricant and determined by experience.

Specifically, as shown in FIG. 2, the drum cleaning unit 10 has the brush roller 10-2 which is rotated in synchronism with, but in the opposite direction to, the drum 9. The roller 10-2 removes the toner remaining on the drum 9 after the primary transfer either mechanically or electostatically, while sliding on the surface of the drum 9. The lubricant 39 whose major component is zinc stearate is constantly held in contact with the roller 10-2. The roller 10-2 in rotation shaves off the lubricant 39 in the previously mentioned cleaning step. As a result, the lubricant 39 is applied to the surface of the drum 9 and then leveled by the rubber blade 10-3 located downstream of the roller 10-2. If desired, the application of the lubricant 39 may be effected intermittently. It is to be noted that zinc stearate is selected because it is easy to mold and because it has no adverse influence on the drum 9 as to image formation. Hence, zinc stearate may be replaced with any other comparable substance.

The lubricant 39 reduces the surface energy of the drum 9 and thereby enhances the parting ability of the toner on the drum 9. Consequently, desirable transfer of the toner from the drum 9 to the belt 19 is promoted.

In accordance with the present invention, a lubricant is also applied to the surface of the intermediate body in parallel with the application of the lubricant to the image carrier. Specifically, the lubricant 37 is applied to the belt 19 when the lubricant 39 is applied to the drum 9, as follows.

In order that the surface energy of the intermediate body be greater than or equal to the surface energy of the image carrier, it is sometimes required to apply the lubricant 37 also made of zinc stearate to the belt 19 in parallel with the application of the lubricant 39 to the drum 9. The amounts of application of lubricants to the image carrier and intermediate body for a unit time are so adjusted to maintain the above relation.

Further, in a duplex copy mode for forming an image on both sides of a transfer medium, after toner has been transferred to and fixed on the front (facing upward at first) of the medium, the medium is turned over by a mechanism, not shown, with the result that the front faces downward. Then, toner is transferred to the other side or rear, now facing upward, of the medium by the secondary transfer. However, at the time of the secondary transfer to the rear of the medium, fixing oil applied to the heat roller has already been deposited on the medium in order to enhance the parting ability of the medium from the heat roller. Hence, the surface energy of the rear is far lower than at the time of the image transfer to the front. In this condition, in order to avoid the local omission of an image, the surface energy of the intermediate body must be greater than or equal to the surface energy of the image carrier, but smaller than or equal to the surface energy of the transfer medium. It follows that in the duplex copy mode the surface energy of the belt 19 must be smaller than in a simplex copy mode.

The present invention satisfies the above relation by applying a lubricant to both the image carrier and the intermediate body, thereby eliminating locally omitted images in the duplex copy mode. Specifically, as shown in FIG. 2, an applying device 36 is located to face the belt 19 in the vicinity of the roller 35. The device 36 has the flat lubricant 37 and a brush or applicator 38 sliding on the surface of the lubricant 37. The lubricant 37 is produced by melting a lubricant additive whose major component is zinc stearate, and then solidifying it by cooling. It is to be noted that zinc stearate is selected because it is easy to mold and because it has no adverse influence on the belt 19 as to image formation. Hence, zinc stearate may be replaced with any other comparable substance.

The device 36 is activated when a predetermined image forming operation is completed, e.g., every time fifty images are formed. The brush 38 is rotated by a drive mechanism, not shown. A solenoid, not shown, causes the device 36 to move such that the brush 38 remains in contact with the belt 19 for a preselected period of time (corresponding to two to three rotations of the belt 19). The part of the lubricant 37 shaved off by the brush 38 is uniformly applied to the belt 19 by the brush 38.

By the above configuration, the surface energy of the drum 9 and that of the belt 19 are each lowered to a particular level, so that not only the primary transfer but also the secondary transfer are improved.

In accordance with the present invention, the lubricant applied to the image carrier gives it the surface energy which is smaller than or equal to the surface energy given to the intermediate body. That is, in order that the surface energy of the intermediate body may be greater than or equal to the surface energy of the image carrier, but smaller than or equal to the transfer medium, the lubricant applied to the drum 9 gives it the surface energy smaller than or equal to the surface energy of the belt 19. Hence, the surface energy of the drum 9 does not obstruct the transfer of the toner from the drum 9 to the belt 19, so that the parting ability of the toner from the drum 9 and, therefore, the primary transfer is improved.

When the lubricant is constantly held in contact with the brush roller 10-2 and applied to the drum 9 via the roller 10–22 due to the rotation of the roller 10-2, the parting ability of the toner from the drum 9 comparable with or even superior to the parting ability from the belt 19 is achievable. This promotes desirable primary transfer.

The condition that the surface energy of the intermediate body be greater than or equal to the surface energy of the image carrier cannot be satisfied unless a greater amount of lubricant is applied to the image carrier than to the intermediate body. Generally, various members are arranged around the image carrier. Hence, it is often difficult to allocate an exclusive space to a moving mechanism for intermittently applying the lubricant to the image carrier. In such a case, the above relation will be satisfied if the application of the lubricant to the image carrier is continuous while the application of the lubricant to the intermediate body is intermittent.

In accordance with the present invention, the lubricant applied to the drum 9 is identical with the lubricant applied to the belt 19. This satisfies the condition that the surface energy of the intermediate body be greater than or equal to the surface energy of the image carrier, but smaller than or equal to the surface energy of the transfer medium. That is, the surface energy of the image carrier and that of the intermediate body are equal to each other. This does not deteriorate the adhering force of the toner, i.e., the primary transfer ability.

Further, in order to satisfy the above relation in surface energy, a greater amount of lubricant is applied to the image carrier than to the intermediate body for a unit time.

Hereinafter will be described a relation between the variation in the surface energy of the image carrier and intermediate body and the transfer ability. As shown in FIGS. 4–7, the range in which the primary transfer is defective is determined by the relative difference between the surface energy of the image carrier or drum 9 and that of the intermediate body or belt 19. Also, the range in which the secondary transfer is defective is determined by the absolute value of the surface energy of the belt 19. Specifically, as for the surface energy of the belt 19 and the transfer medium or paper 24, they depend on whether or not the condition that the surface energy of the belt 19 be smaller than or equal to the surface energy of the paper 24 is satisfied. However, it is, of course, impossible to control the surface energy of the paper 24. This is why the defective secondary transfer range is determined by the absolute value of the surface energy of the belt 19.

Some different cases will be described hereinafter.

Figure 4:
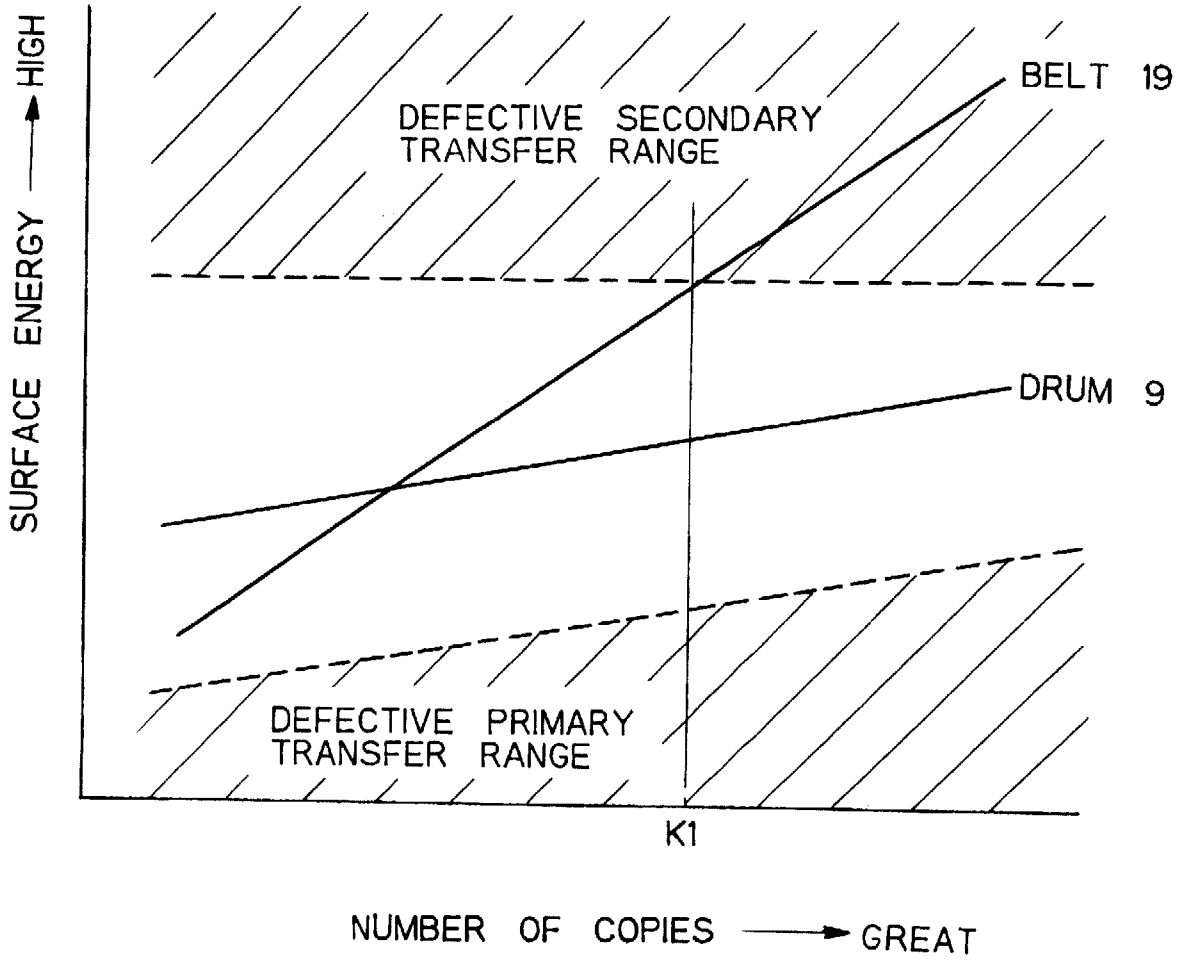
FIGS. 4–7 are graphs each showing particular variations of the surface energy of an intermediate transfer belt and that of a photoconductive element.

(i) Assume that nothing is applied to the image carrier and intermediate body. Then, the surface energy increases on both the image carrier and the intermediate body with an increases in the number of copies. While the surface of the image carrier is ground by the brush roller 10-2, the transfer body is not provided with such a roller. Hence, as the copying operation is repeated, the surface energy of the image carrier sequentially increases due to the tradeoff between the decrease attributable to the grinding of the roller 10-2 and the increase attributable to toner filming. On the other hand, surface energy of the intermediate body increases with a higher rate than the surface energy of the image carrier because it lacks the grinding roller, as shown in FIG. 4. Hence, the condition that the surface energy of the intermediate body be greater than or equal to the surface energy of the image carrier is satisfied, thereby obviating defective primary transfer.

However, as shown in FIG. 4, when the number of copies produced reaches a predetermined number K1, the condition that the surface energy of the intermediate body be smaller than or equal to the surface energy of the transfer medium fails, resulting in a locally omitted image at the secondary transfer stage. Specifically, the primary transfer is satisfactory because the surface energy of the image carrier is smaller than the surface energy of the intermediate body. However, the secondary transfer is defective in the range where the surface energy of the intermediate body is greater than the surface energy of the image carrier.

(ii) Assume that a lubricant is intermittently applied to the intermediate body (prior art). As the copying operation is repeated, the surface energy of the image carrier sequentially increases due to the tradeoff between the decrease attributable to the grinding of the roller 10-2 and the increase attributable to toner filming, as stated above. By contrast, the surface energy of the intermediate body sharply falls when the lubricant is applied and then sequentially increases after the application due to toner filming. As a result, the surface energy of the intermediate body repeatedly varies in a saw-tooth configuration, as shown in FIG. 5.

Although the surface energy of the intermediate body varies in a saw-tooth configuration, as mentioned above, it does not exceed the surface energy of the image carrier, but it maintains a substantially constant level, because the lubricant of small surface energy is intermittently applied. The surface energy of the intermediate body does not reach the defective primary transfer range so long as the toner filming on the image carrier is not noticeable. However, because the surface energy of the intermediate body sequentially increases, it enters the defective primary transfer range when the number of copies produces reaches K2. As a result, defective images including a blurred image appear. This generally occurs because the tradeoff is not balanced, i.e., the surface energy of the intermediate body is not regular.

(iii) Assume that a lubricant is intermittently applied to the intermediate body, and that the same lubricant is also applied to the image carrier. As shown in FIG. 6, the surface energy of the intermediate body varies in a saw-tooth configuration due to the intermittent application of the lubricant, as described with reference to FIG. 5. On the other hand, the surface energy of the image carrier remains constant, as indicated by a dashed line connecting the bottoms of the saw-teeth, because the same lubricant as the lubricant applied to the intermediate body is applied to the image carrier. Hence, the surface energy of the image carrier does not enter the defective primary transfer range or the defective secondary transfer range.

Figure 5:
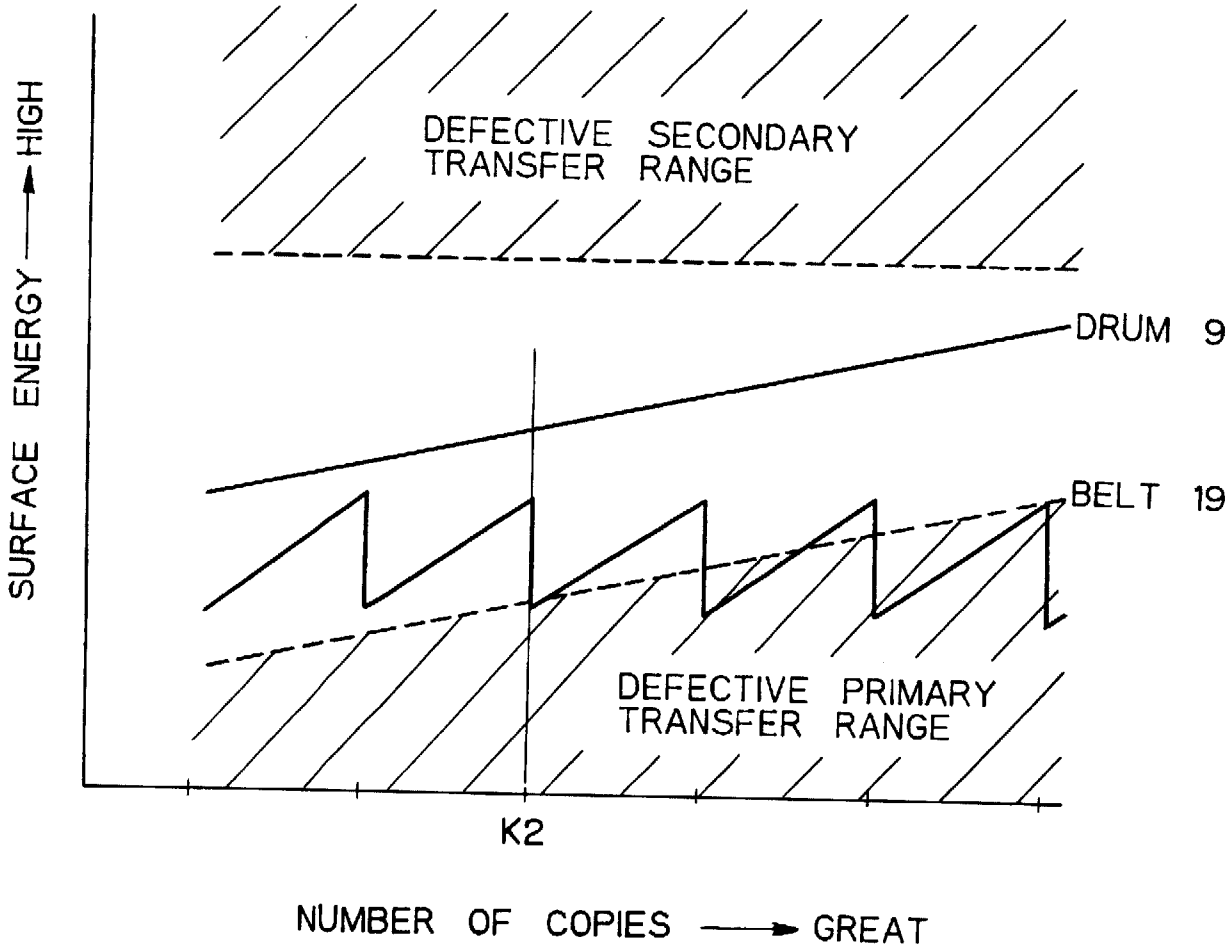
Figure 6:
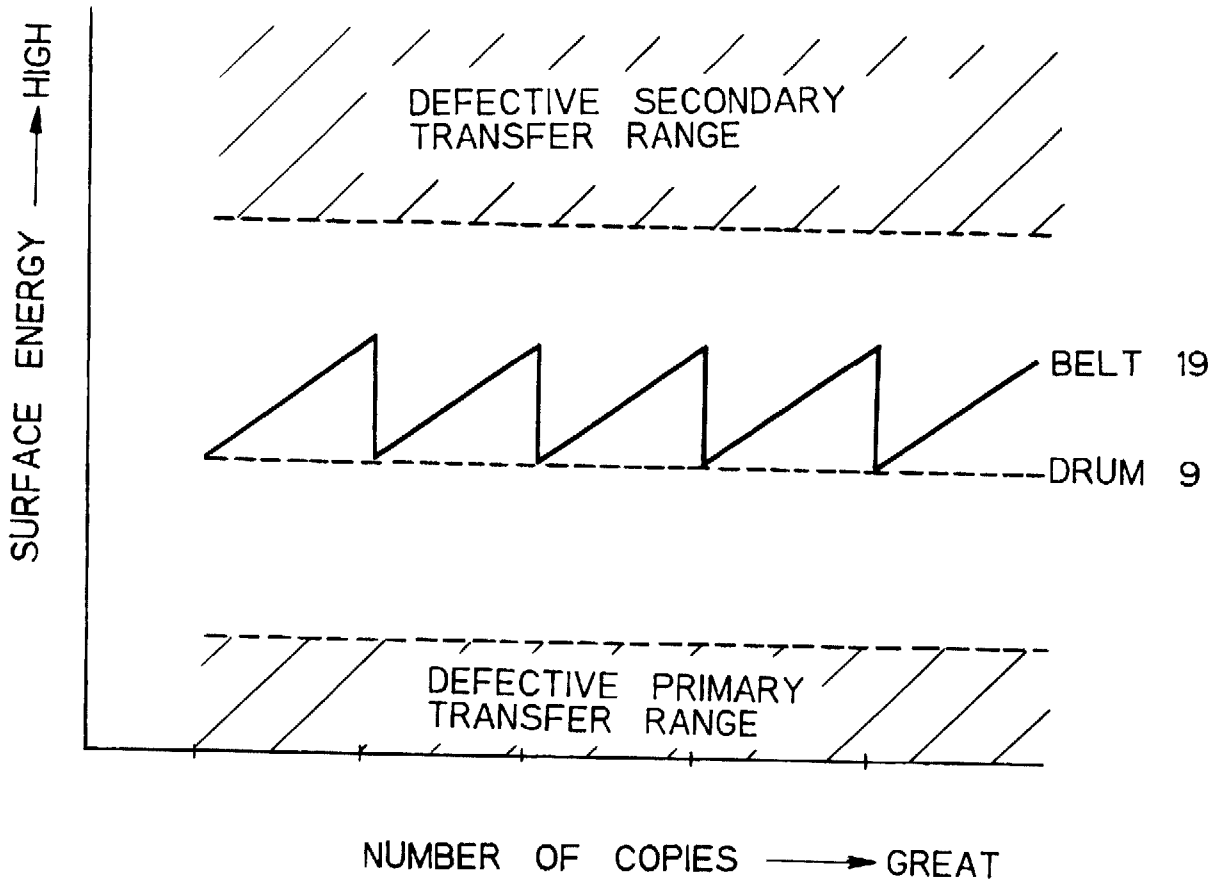
Figure 7:
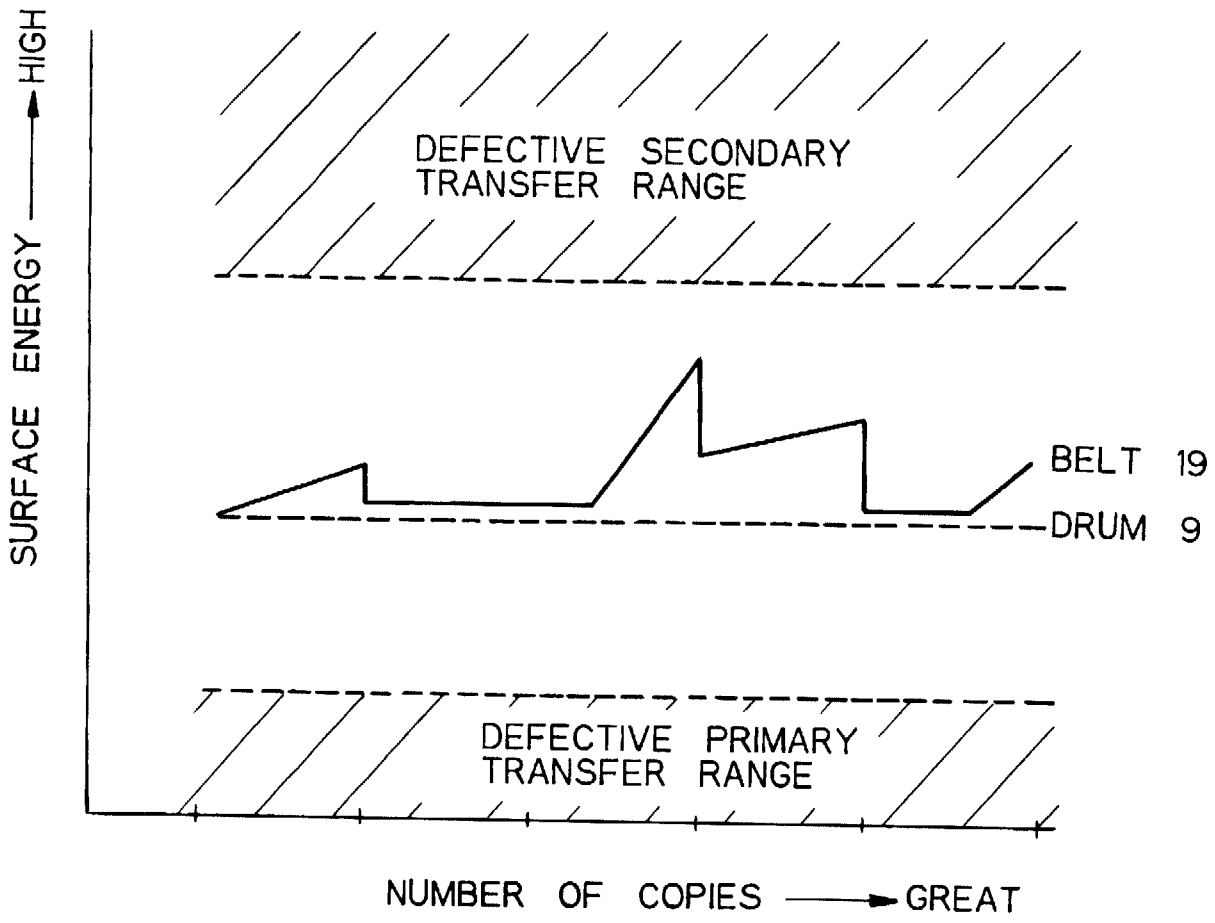

FIG. 7 shows a case wherein the intermediate body is applied with a lubricant in the same condition as in FIG. 5, but the lubricant is of a different kind. In this case, the lubricant on the intermediate body decreases in an irregular manner, or the toner on the body decreases in an irregular manner depending on its distribution on the body. As a result, the surface energy of the intermediate body varies along a random curve, as distinguished from the saw-toothed curve of FIG. 5. However, the surface energy of the intermediate body does not decrease below the surface energy of the image carrier because the same lubricant is applied to the body and image carrier.

(iv) Specific procedures and conditions for the application of the lubricant are as follows.

[Application of Lubricant to Intermediate Body]

(a) Procedure

Step 1

In the color copier shown in FIGS. 2 and 3, the toner image transferred from the drum 9 to the belt 19 by the primary transfer is transferred to the paper 24 by the secondary transfer, as stated previously. The toner left on the belt 19 after the secondary transfer is removed by the rubber blade 22-2 of the belt cleaning unit 22. This cleaning step is effected after every secondary transfer. Every time the cleaning step is repeated fifty times, the lubricant is applied to the belt 19.

Step 2

The brush 38 constantly held contact with the flat lubricant 37 made of zinc stearate is rotated while sliding on the lubricant 37. As a result, the lubricant 37 is deposited on the brush 38.

Step 3

While the condition in step 1 is maintained, the applying device 36 is pressed against the belt 19 by a mechanism, not shown.

Step 4

The zinc stearate applied to the belt 19 is leveled by the rubber blade 22-2 so as to stably cover the surface of the belt 19.

Step 5

The device 36 is held in contact with the belt 19 at least until it applies zinc stearate to the entire periphery of the belt 19. Then, the device 36 is moved away from the belt 19. The brush 38 is brought to a stop after the application of the lubricant to the belt 19.

Step 6

The blade 22-2 of the cleaning unit 22 is held in contact with the belt 19 at least over the area where zinc stearate has been applied. For example, the blade 22-2 is brought out of contact with the belt 19 by the mechanism 22-2 after the area of the belt 19 applied with the lubricant has passed the blade 22-2 twice, i.e., after the belt 19 has completed two turns.

Step 7

The belt 19 is brought to a stop after step S6.

(b) Conditions for Application

The above application is effected under the following conditions:

Belt 19 linear velocity: 180 mm/sec

Brush 38 rotation speed: 600 rpm (rotated in the same direction as belt 19)

Brush 38 material: 20,000/inch$^2$ of 300D/48F conductive acryl fibers (SA-7 (trade name) available from Toray)

Bite of brush 38 into zinc stearate: 1 mm

Bite of brush 38 into belt 19: 1 mm

[Application of Lubricant to Image Carrier]

(a) Procedure

Step 1

A toner image is formed on the drum 9 by the previously stated procedure and then transferred to the belt by the primary transfer. Most of the toner left on the drum 9 is removed by the brush roller 10-2 of the drum cleaning unit 10. The roller 10-2 is rotated by a mechanism, not shown, in the opposite direction to the drum 9. The roller 10-2 catches the toner mechanically and electrically while sliding on the drum 9. The toner caught by the brush is transferred to the bias roller 10-4 to which a bias voltage opposite in polarity to the toner is applied. As a result, the roller 10-2 is cleaned.

Step 2

The flat lubricant 38 made of zinc stearate is constantly held in contact with the roller 10-2. The lubricant 39 is shaved off by the roller 10-2 and then deposited on the brush.

Step 3

The roller 10-2 is caused to slide on the drum 9. Zinc stearate deposited on the brush 38 is applied to the surface of the drum 9 in the same manner as the application of the lubricant to the belt 19.

Step 4

Zinc stearate applied to the drum 19 is leveled by the rubber blade 10-3 following the roller 10-2 and stably covers the surface of the drum 19.

Step 5

The drum cleaning unit 10 is constantly held in contact with the drum 9, and the roller 10-2 is driven in synchronism with the drum 9. As a result, zinc stearate is constantly applied to the drum 9, maintaining the surface energy of the drum 9 stable.

(b) Conditions for Application

The lubricant is applied to the drum 9 under the following conditions:

Drum 9 linear velocity: 180 mm/sec

Roller 10-2 rotation speed: 170 rpm (rotated in the opposite direction to drum 9)

Brush material: 20,000/inch$^2$ of 300D/48F conductive fibers (SA-1)

Bite of brush into zinc stearate: 1 mm

Bite of brush into drum 9: 1 mm

The lubricant 39 may be directly held in contact with the drum 9 without the intermediary of the brush roller, if desired.

The lubricant may be applied to the drum 9 in a greater amount than to the belt 19 for a unit time in order to set up the conditions, e.g., adhering force, surface energy and surface tension capable of eliminating locally omitted images. The surface energy of the drum 9 is maintained constant by the lubricant. As to the surface of the belt 19, immediately after the application of the lubricant, it regains the same condition as before the application so long as the accounts of the lubricant are balanced. Hence, the surface energy of the belt 19 dos not reach the defective primary transfer range or the defective secondary transfer range.

In practice, the lubricant on the belt 19 does not vary as regularly as shown in FIG. 6. However, if the surface energy of the drum 9 remains constant, neither the drum 9 nor the belt 19 enters the defective primary transfer range even though the surface energy of the belt 19 may vary as shown in FIG. 7. This insures stable transfer free from local omission as in FIG. 5.

While the application of the lubricant to the drum 9 has been shown and described as being implemented by the brush roller 10-2, an exclusive applying device independent of the drum cleaning unit 10 may be used as with the belt 19.

In accordance with the present invention, when the surface tension of the intermediate body is selected to be greater than or equal to the surface potential of the image carrier, the surface roughness of the intermediate body is selected to be 0.6 to 0.9 μm (ten-point mean roughness as prescribed by JIS B0601). The surface roughness is related to the improvement in transfer ability, as stated earlier. Adding the above condition relating to the surface roughness is successful to further insure the prevention of locally omitted images.

In summary, it will be seen that the present invention provides an image forming apparatus capable of protecting images from being locally lost in spots.

Various modifications will become possible for those skilled in the art after receiving the teachings of the present disclosure without departing from the scope thereof.

What is claimed is:

1. An image forming apparatus, comprising:

an image carrier for carrying a developed image;

a transfer medium;

an intermediate transfer body for transferring said developed image from said image carrier to said intermediate transfer body via a primary transfer, and from said intermediate transfer body to said transfer medium via a secondary transfer; and a motion control device for maintaining said image carrier and said transfer medium at a common linear velocity different from a linear velocity of said intermediate transfer body thereby adding a shearing force to said developed image between said image carrier and said intermediate transfer body and between said intermediate transfer body and said transfer medium to assist in the transfer of said developed image in said primary and secondary transfers, wherein the developed image when expanded or contracted at said primary transfer, because of different linear velocities of said intermediate transfer body and said image carrier, is respectively contracted or expanded at said secondary transfer by a comparable amount as during said primary transfer, because of different linear velocities of said intermediate transfer body and said transfer medium, to thereby transfer said developed image to said transfer medium with a size comparable to the developed image prior to said primary transfer.

2. The apparatus according to claim 1, wherein said intermediate transfer body has a surface tension greater than or equal to a surface tension of said image carrier.

3. The apparatus according to claim 2, wherein said intermediate transfer body has a surface potential of less than 41 dyn/cm, inclusive of 41 dyn/cm.

4. The apparatus according to claim 2, wherein said intermediate transfer body has a surface roughness of 0.6 to 0.9 μm in terms of a ten-point mean roughness as prescribed by JIS B060.

5. The apparatus according to claim 2, wherein the surface tension of the intermediate transfer body is greater than or equal to the surface tension of said image carrier, but smaller than or equal to a surface tension of the transfer medium in an actual operating condition.

6. An apparatus as claimed in claim 5, wherein said intermediate transfer body has a surface roughness of 0.6 to 0.9 μm in terms of a ten-point means roughness as prescribed by JIS B060.

7. The apparatus according to claim 1, wherein said intermediate transfer body has a surface energy greater than or equal to a surface tension of said image carrier.

8. The apparatus according to claim 7, wherein a lubricant is applied to a surface of said image carrier in order to reduce the surface energy.

9. The apparatus according to claim 7, wherein a lubricant is applied to a surface of said image carrier and a surface of said intermediate transfer body in order to reduce the surface energy.

10. An apparatus as claimed in claim 9, wherein the lubricant applied to said image carrier gives said image carrier the surface energy smaller than or equal to the surface energy given to said intermediate transfer body by the lubricant.

11. The apparatus according to claim 7, wherein the lubricant applied to said image carrier and the lubricant applied to said intermediate transfer body are identical.

12. An apparatus as claimed in claim 9, wherein the lubricant is applied to said image carrier in a greater amount than the lubricant applied to said intermediate transfer body for a unit time.

13. The apparatus according to claim 1, wherein said intermediate transfer body has an adhering force acting on toner of said developed image that is greater than or equal to an adhering force acting between said toner and said image carrier.

14. The apparatus according to claim 13, wherein the adhering force acting between said intermediate transfer body and the toner is greater than or equal to the adhering force acting between said image carrier and toner, but smaller than or equal to an adhering force acting between the transfer medium and the toner.

* * * * *